US010006207B2

(12) United States Patent
Grommet

(10) Patent No.: US 10,006,207 B2
(45) Date of Patent: Jun. 26, 2018

(54) OPEN STAIR CASE WITH CENTER UNCUT STRINGER

(71) Applicant: Dean G Grommet, Whitefish, MT (US)

(72) Inventor: Dean G Grommet, Whitefish, MT (US)

( * ) Notice: Subject to any disclaimer, the term of this patent is extended or adjusted under 35 U.S.C. 154(b) by 0 days. days.

(21) Appl. No.: 14/859,190

(22) Filed: Sep. 18, 2015

(65) Prior Publication Data

US 2016/0369514 A1 Dec. 22, 2016

Related U.S. Application Data

(60) Provisional application No. 62/183,151, filed on Jun. 22, 2015.

(51) Int. Cl.

| | |
|---|---|
| ***E04F 11/028*** | (2006.01) |
| ***E04F 11/112*** | (2006.01) |
| ***E04F 11/025*** | (2006.01) |
| *E04F 11/02* | (2006.01) |

(52) U.S. Cl.

CPC ..... *E04F 11/028* (2013.01); *E04F 11/025* (2013.01); *E04F 11/112* (2013.01); *E04F 2011/0209* (2013.01)

(58) Field of Classification Search

CPC ... E04F 11/028; E04F 11/0223; E04F 11/025; E04F 2011/1046

USPC ..... 52/182, 188, 190, 191

See application file for complete search history.

(56) References Cited

U.S. PATENT DOCUMENTS

| | | | | | |
|---|---|---|---|---|---|
| 2,593,683 | A * | 4/1952 | Lyons | E04F 11/035 | 182/194 |
| 3,667,572 | A * | 6/1972 | Anderson | E06C 7/083 | 182/220 |
| 3,747,709 | A * | 7/1973 | Ridenour | E04F 11/025 | 182/219 |
| 3,851,431 | A * | 12/1974 | Klein | B28B 7/225 | 182/217 |
| 3,981,112 | A * | 9/1976 | Dake | E04F 11/025 | 52/184 |
| 3,994,113 | A * | 11/1976 | Souza, Jr. | E04F 11/025 | 52/184 |
| 5,167,102 | A * | 12/1992 | Nakatsubo | E04F 11/00 | 52/183 |
| 5,349,795 | A * | 9/1994 | French | E04F 11/022 | 52/183 |
| 5,791,101 | A * | 8/1998 | Wallace | E04F 11/108 | 248/247 |

(Continued)

FOREIGN PATENT DOCUMENTS

| | | | | |
|---|---|---|---|---|
| DE | 1509551 A1 * | 8/1969 | ..... | E04F 11/028 |
| DE | 1683613 A1 * | 11/1969 | ..... | E04F 11/028 |

(Continued)

OTHER PUBLICATIONS

Web Page Ad, "Floating Staircases" http://www.decoist.com/2013-04-17/suspended-style-floating-staircase-ideas-for-the-contemporary-home/.

*Primary Examiner* — Babajide A Demuren

(57) ABSTRACT

An open staircase is provided comprising a flight of stair treads and an uncut stringer. The treads have free opposing ends positioned on the stringer in a stepped apart relationship relative to one another and each are fixed to the uncut stringer at a position along the horizontal length of the tread such that the tread is cantilevered from the stringer.

5 Claims, 12 Drawing Sheets

(56) References Cited

U.S. PATENT DOCUMENTS

| | | | | |
|---|---|---|---|---|
| 7,946,084 | B2 * | 5/2011 | Gibson | E04F 11/1043 52/182 |
| 2005/0081461 | A1 * | 4/2005 | Gibson | E04F 11/025 52/188 |
| 2005/0097835 | A1 * | 5/2005 | Nishimoto | E04F 11/0226 52/182 |
| 2006/0260224 | A1 * | 11/2006 | Grenier | E04F 11/16 52/182 |
| 2013/0305635 | A1 * | 11/2013 | McCool | E04F 11/163 52/179 |

FOREIGN PATENT DOCUMENTS

| | | | | | |
|---|---|---|---|---|---|
| DE | 1659752 | A1 * | 12/1969 | | E04F 11/025 |
| DE | 2016265 | A1 * | 10/1971 | | E04F 11/022 |
| DE | 2315329 | A1 * | 10/1974 | | E04F 11/022 |
| DE | 3519381 | A1 * | 12/1986 | | E04F 11/0255 |
| DE | 29918905 | U1 * | 3/2000 | | E04F 11/00 |
| DE | 19716986 | C2 * | 7/2001 | | E04F 11/0255 |
| DE | 102004049067 | * | 1/2006 | | E04F 11/028 |
| EP | 2169140 | A2 * | 3/2010 | | E04F 11/025 |
| EP | 2402531 | A2 * | 1/2012 | | E04F 11/025 |
| FR | 1004713 | A * | 4/1952 | | E04F 11/025 |
| FR | 1520780 | A * | 4/1968 | | E04F 11/022 |
| FR | 2450321 | A1 * | 9/1980 | | E04F 11/025 |
| FR | 2540164 | A1 * | 8/1984 | | E04F 11/025 |
| JP | 06057899 | A * | 3/1994 | | |
| WO | WO 9301377 | A1 * | 1/1993 | | E04F 11/028 |
| WO | WO2014019054 | A1 | 7/2014 | | |

* cited by examiner

OPEN STAIR CASE WITH CENTER UNCUT STRINGER

CROSS REFERENCE TO RELATED APPLICATIONS

This application claims the benefit of Provisional Application No. 62/183,151, confirmation No. 5541 filed Jun. 22, 2015, the disclosure of which is hereby expressly incorporated in its entirety by reference herein.

FIELD OF USE

Embodiments of the present disclosure find applicability in the field of staircases and staircase construction.

BACKGROUND

Open staircases are well known in the art. They typically are constructed to provide a sense of space and of freedom. Often there are no risers, or the risers are shortened in height, so you can see through the staircase to what is beyond. Typically, the treads are fixed between two stringers which may include cuts to form flat surfaces on which the treads can sit. Where stringers are uncut, an additional component typically is provided to the stringer to provide the flat surface on which the tread can sit. Alternatively, the stringers can form side walls which the treads span, and to which the opposing side edges of the treads are connected. In a variation on an open staircase, a side edge of a tread may be cantilevered from a single stringer or a wall. These are known as floating staircases.

SUMMARY

This summary is provided to introduce a selection of concepts in a simplified form that are further described below in the Detailed Description. This summary is not intended to identify key features of the claimed subject matter on its own, nor is it intended to be used on its own as an aid in determining the scope of the claimed subject matter.

The present disclosure relates, in one embodiment, to an open staircase. The staircase includes an uncut stringer and a plurality of horizontal steps that include treads positioned on the stringer in a stepped apart relationship relative to one another. The stringer further includes a plurality of openings or apertures on its tread-facing surface, the openings being positioned and dimensioned to receive a pin extending down from the tread so as to secure the tread to the stringer. In one preferred embodiment the opening is perpendicular to the longitudinal plane of the stringer. In another preferred embodiment, the pin extends down from the riser end of the tread such that when the pin is inserted in a stringer opening, the tread is effectively cantilevered over the stringer. In another embodiment, the pin can extend down from the tread at an angle. In still another embodiment, the open staircase of the present disclosure includes a plurality of stringers. In still another embodiment, the stringers span a central section of the treads and the opposing tread ends are free.

Provided herein is an improvement in open staircases that provide the aesthetic illusion of stairs projecting out from uncut stringers and without additional components provided to the stringer to fix treads to it. Also provided herein are open staircases consisting essentially of a tread and stringer, wherein the tread includes a pin extending therefrom and dimensioned to fit into an aperture in a stringer surface.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, where like-numbered parts reference like-membered components and wherein.

DETAILED DESCRIPTION

Embodiments of the present disclosure provide staircases, components, and methods of production of these. In particular, embodiments of the present disclosure provide open staircases that include stair treads with free opposing ends and uncut stringers attached to a portion of the bottom planar surface of a horizontal stair tread so as to provide a cantilevering surface from which the tread can extend to provide a load bearing surface for stepping on and moving between floors.

Terms and Definitions

As used herein, "open staircase" refers to staircases having horizontal stair treads with free, unattached opposing ends, and fixed to at least one stringer along the planar length of the tread. The terms "opening" and "aperture" are used interchangeably and refer to a hole or gap extending at least partway into a stringer from the tread-facing surface of the stringer.

Figure 1:
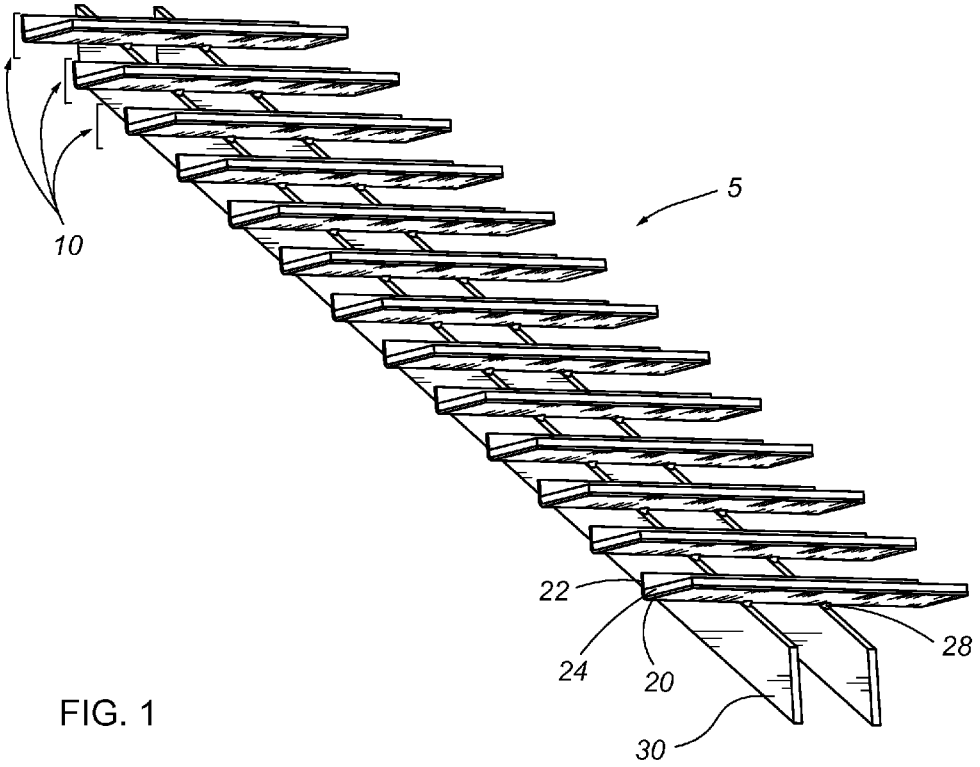
FIG. 1 is a perspective view of a staircase according to the present disclosure.
Figure 2:
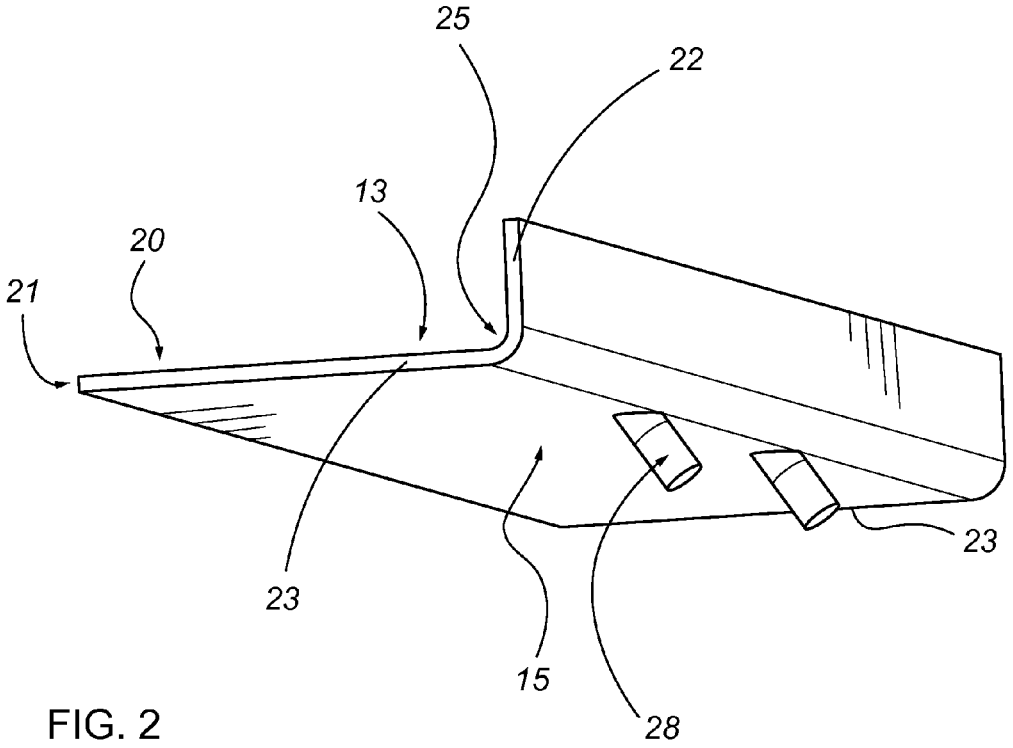
FIG. 2 is a perspective view of a stair tread according to one embodiment of the present disclosure.

FIG. 1 illustrates an open staircase 5 according to the present disclosure. The staircase 5 is configured to provide a stairway or path that connects one floor to another, and/or to a landing between floors. Staircase 5 includes a flight or set of horizontal steps 10 from the bottom to the top of staircase 5. Horizontal steps 10 are positioned on a plurality of stringers 30 in a stepped apart relationship relative to one another. Referring also to FIGS. 2-4, embodiments of a horizontal stair step 10 in accordance with the present disclosure are shown. The step can include a tread 20 which is the horizontal member of step 10 and, optionally, a riser 22 which, if present, is the vertical member of step 10. The tread can include a front or nose edge 21, and a rear or riser edge, 25. It also can include horizontal opposing edges 23, a top planar surface 13, and a bottom planar surface 15. The step further can include a pin 28 extending down from the stringer-facing or bottom planar surface 15 of the tread. In one preferred embodiment, illustrated here, pin 28 can be positioned near the rear or riser edge 25 of the tread. In another embodiment, pin 28 is positioned such that only riser edge 25 of bottom planar tread surface 15 touches or substantially touches stringer 30. As will be appreciated by those having ordinary skill in the art, pin 28 may be made of the same material as the tread, or it may be different. It also can be made integral to the tread bottom planar surface or attached separately. In one example, both the tread 20 and pin 28 are made of a structural metal.

Figure 3A:
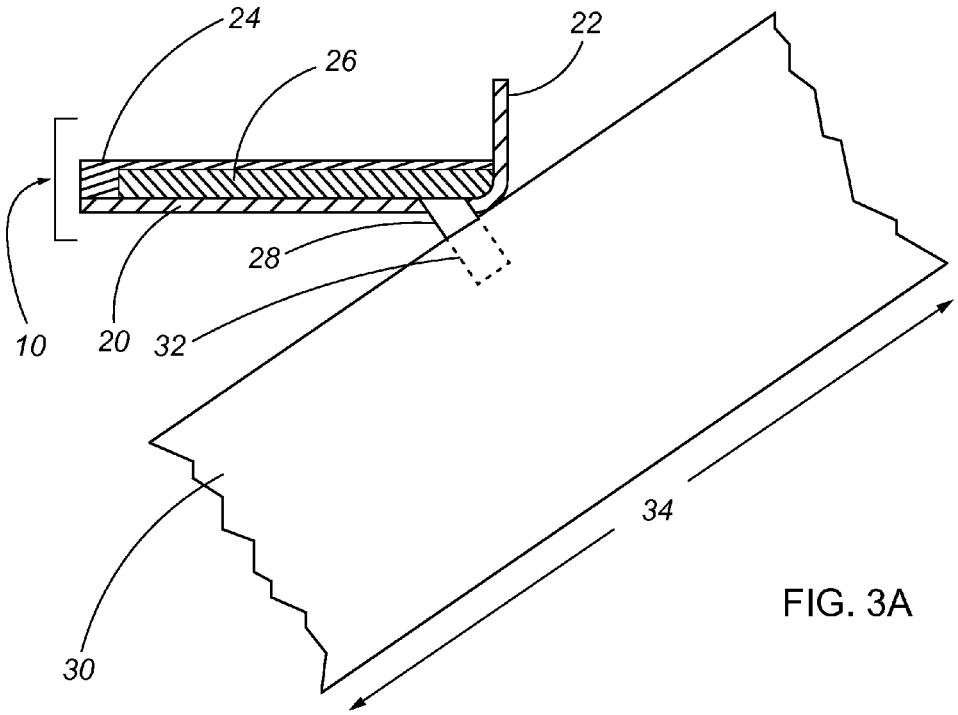
FIGS. 3A and 3B are a side view of a tread according to one embodiment of the present disclosure and secured to a stringer.
Figure 3B:
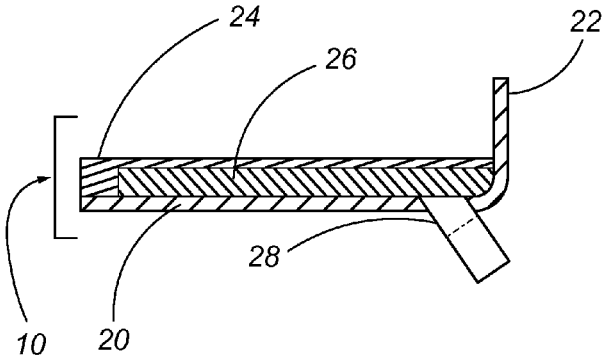
Figure 4:
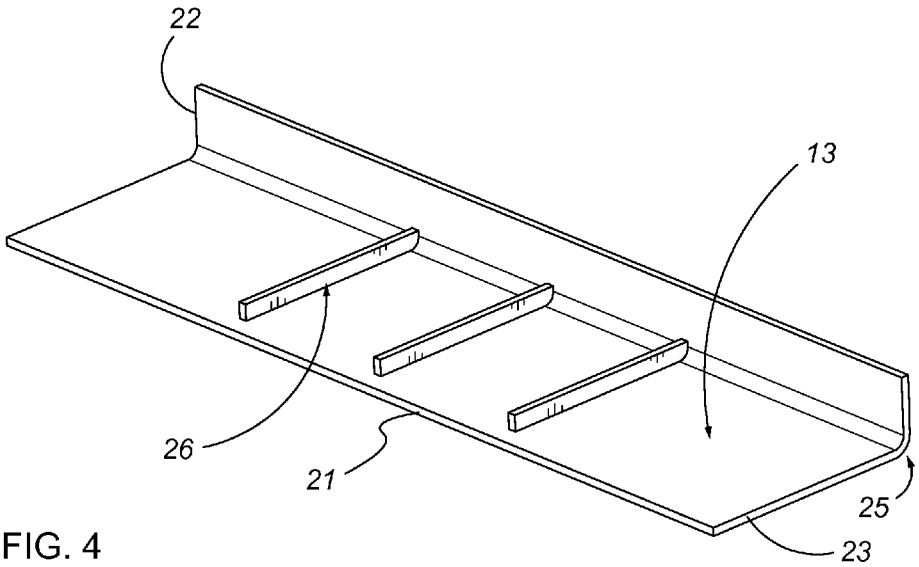
FIG. 4 is a perspective view of a stair tread according to another embodiment of the present disclosure.
Figure 5:
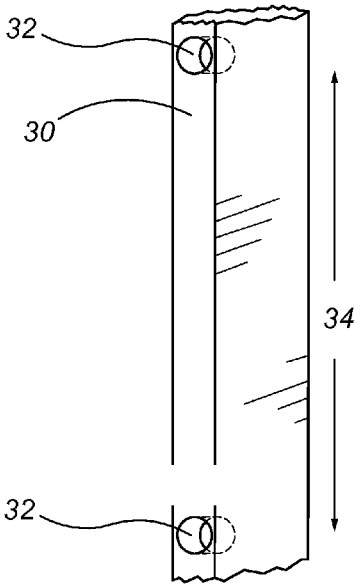
FIG. 5 is an illustration of a stringer of the present disclosure.
Figure 6:
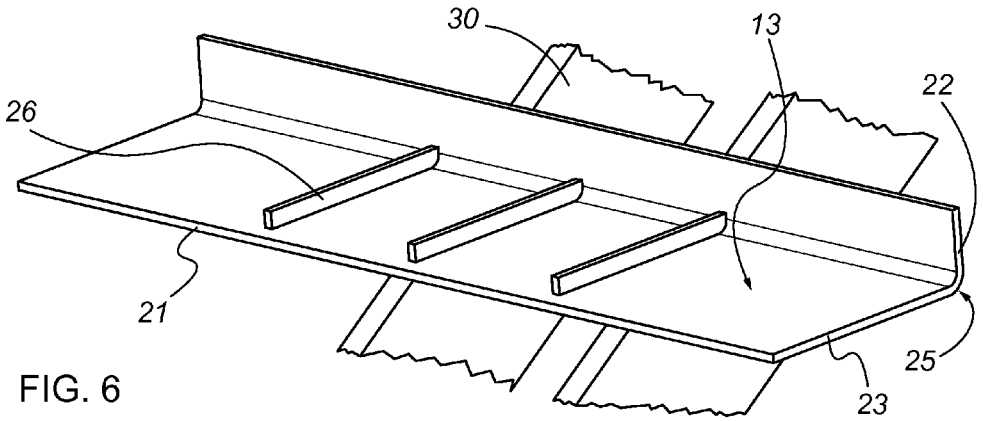
FIG. 6 is a perspective view of a tread according to one embodiment of the present disclosure secured to a stringer.
Figure 7:
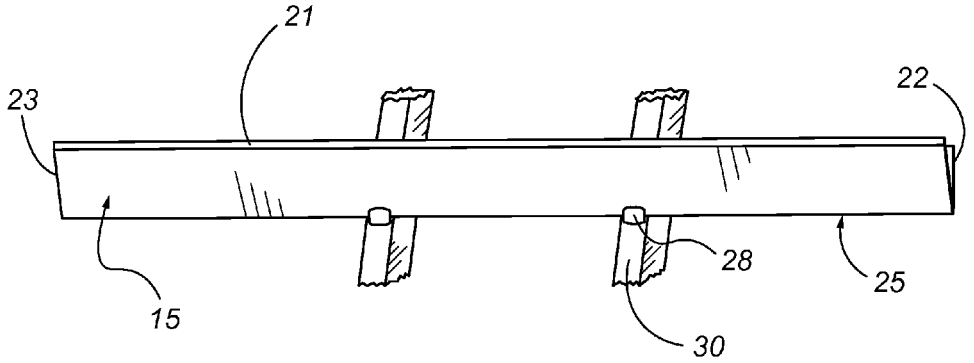
FIG. 7 is view looking up a staircase of the present disclosure from below.

As illustrated in FIGS. 3A, 3B and 5, stringers 30 of the present disclosure include apertures or openings 32 dimensioned and positioned to receive a pin 28. When tread pin 28 is in stringer aperture 32, step 10 is effectively cantilevered out from stringer 30 along tread 20's horizontal length or bottom planar surface 15, providing the illusion of steps floating out from uncut centrally spaced stringers, as illustrated in FIGS. 7-10, and 13. In one embodiment, aperture 32 is approximately perpendicular to the longitudinal plane 34 of stringer 30. In another embodiment, pin 28 extends down at an oblique angle relative to the tread horizontal planar surface 15. In another embodiment the oblique pin angle is greater than about 90 degrees. In another embodiment, the angle is greater than about 100 degrees.

Figure 12:
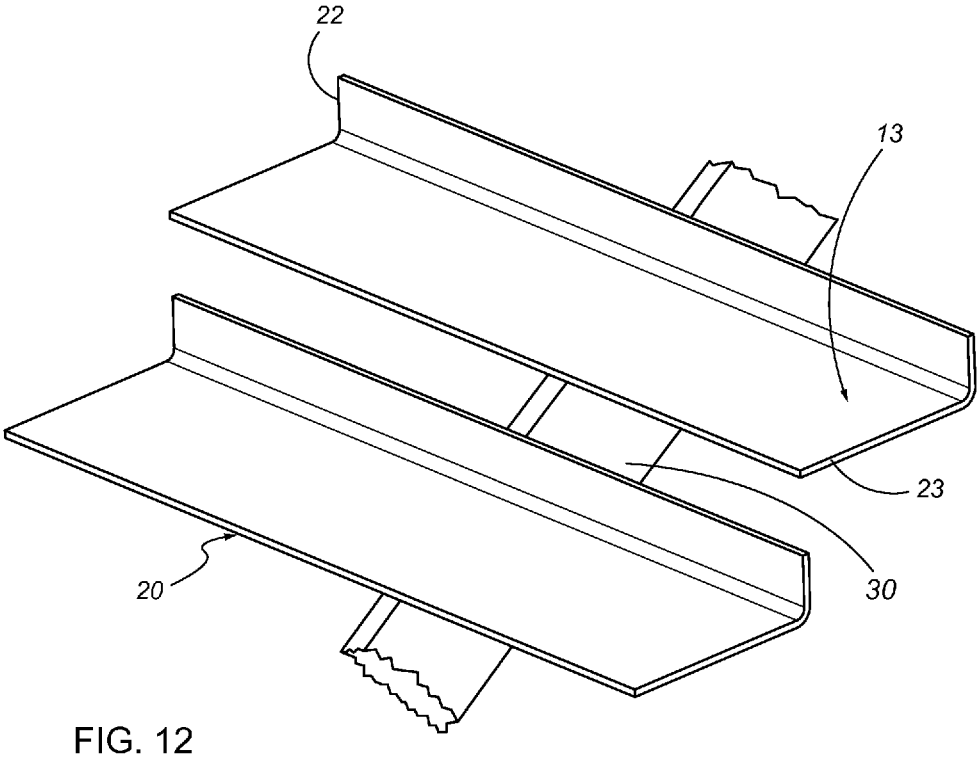
FIG. 12 is a perspective view of a portion of a staircase according to one embodiment of the present disclosure, comprising a single stringer.
Figure 13:
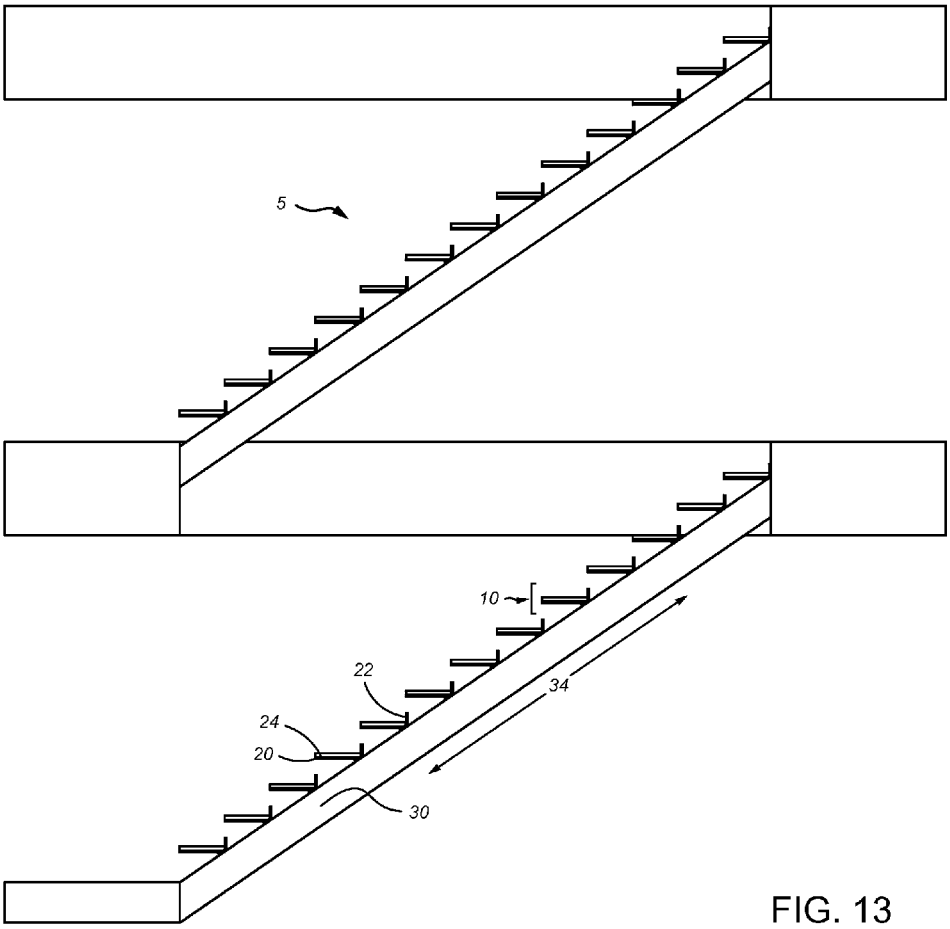
FIG. 13 is a side view of staircases connecting multiple floors according to one embodiment of the present disclosure.
Figure 14:
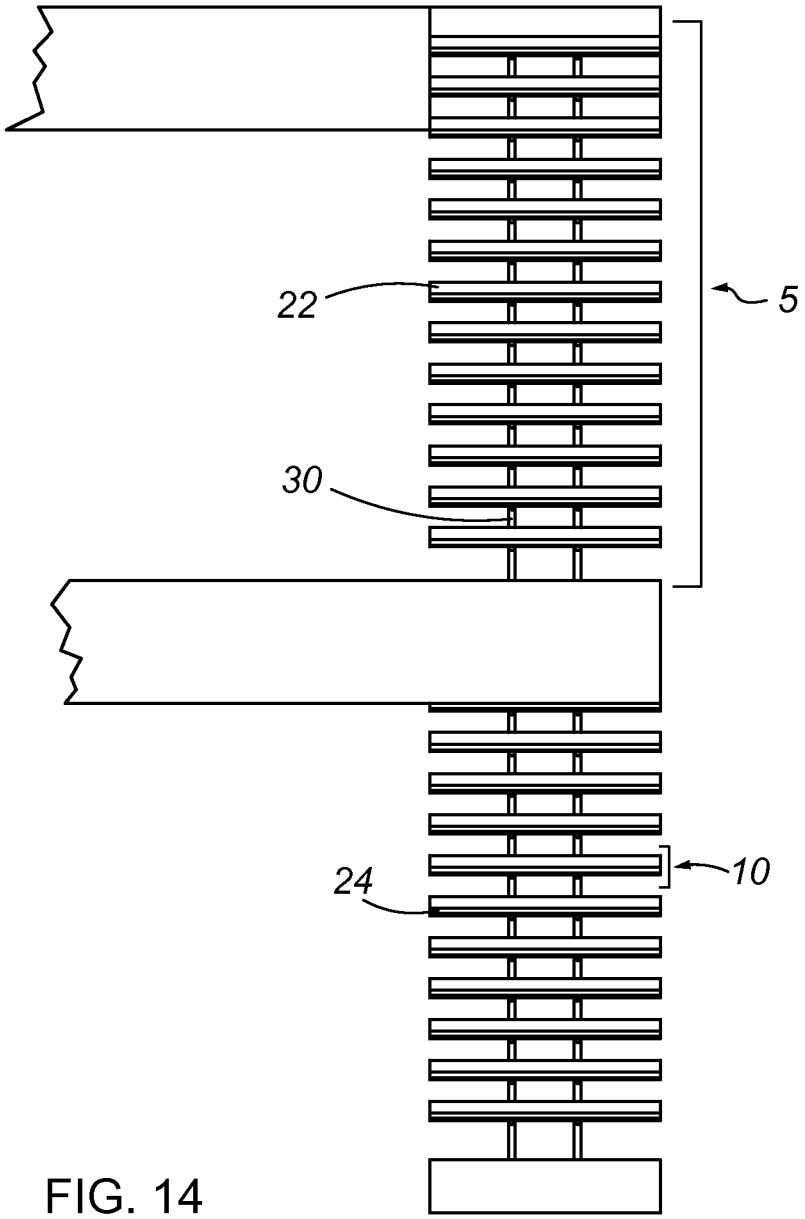
FIG. 14 is a front view of staircases connecting multiple floors according to one embodiment of the present disclosure.

In the example presented herein in FIGS. 1, 2, 6, 7, 9, 10 and 14, a pair of stringers are provided, spaced about the central span of horizontal step 10. Also contemplated are examples comprising a single stringer (FIG. 12), or a plurality of three or more stringers, as desired for aesthetic or structural effect. In all examples, the stringers are fixed to the tread at positions along the planar bottom surface of tread 20, and the free opposing tread ends 23 are free. In one embodiment, stringers are positioned along the central spanning portion of a tread. In the case of a single stringer it is positioned at substantially the center of the tread's horizontal length. In the case of a pair of stringers, the stringers are substantially equidistant from the stair tread's horizontal center. In another embodiment, treads and stringers can be constructed such that stringers can be positioned at other locations along the tread horizontal length, including "off center", provided both opposing tread ends 23 remain free.

As will be appreciated by those having ordinary skill in the art, tread 20 and stringer 30 can be made of any material that provides the desired structural support for a functional staircase. Wood, metal, concrete, stone, ceramic, glass and glass laminate are some of the well-known and well-characterized materials that can be used to advantage. Similarly, the materials and dimensions chosen for tread pin 28 can be selected using standard means for ease of construction and desired structural support. Simply by way of illustration, useful tread pins can have diameters in the range of about 0.5-2.0 inches, and lengths in the range of about 1-3 inches. As will be appreciated by those having ordinary skill in the art, preferred dimensions can vary from these ranges, depending on, for example, choice of materials selected, number of stringers, step dimensions, staircase pitch and desired weight-bearing loads.

As illustrated in FIGS. 3-6, step 10 can include components in addition to tread 20. For example, features to enhance structural stability of a step can be included. One example of such a feature is illustrated in FIG. 4 where a plurality of fins 26 are shown. In addition, a stepping surface 24 can be placed over part or all of the top planar surface of the tread. Examples of useful materials include, without limitation, wood, wood laminates, carpet, synthetic or natural rubber, cushioning materials, and the like.

Also as will be appreciated by those having ordinary skill in the art, risers 22 can optionally be included. These can be integral to the tread, as illustrated in FIG. 2, or can be constructed separately.

Figure 8:
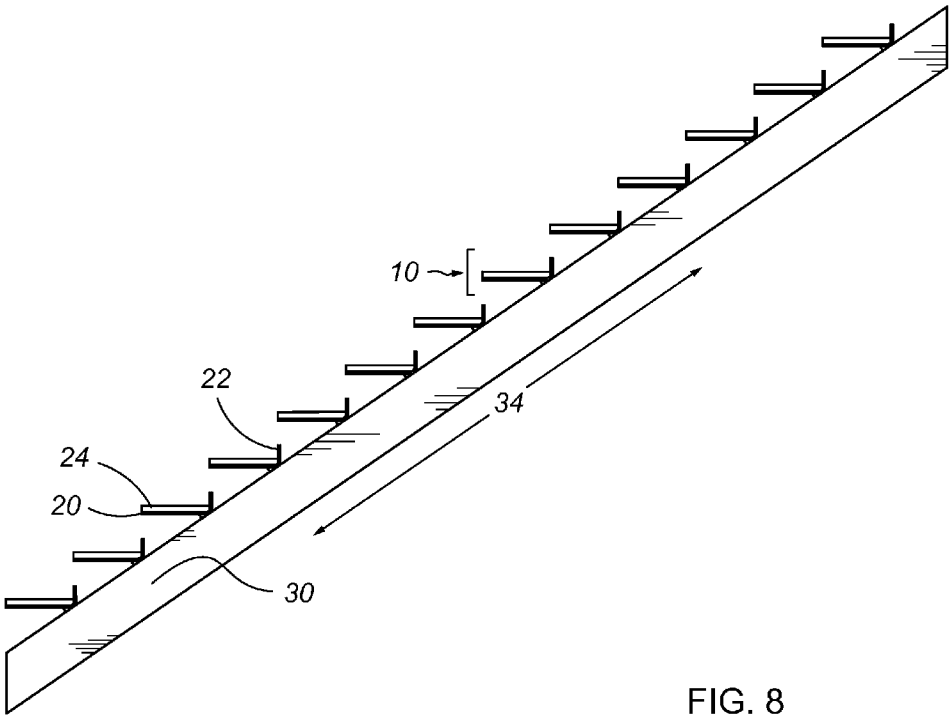
FIG. 8 is a perspective side view of a staircase of the present disclosure.
Figure 9:
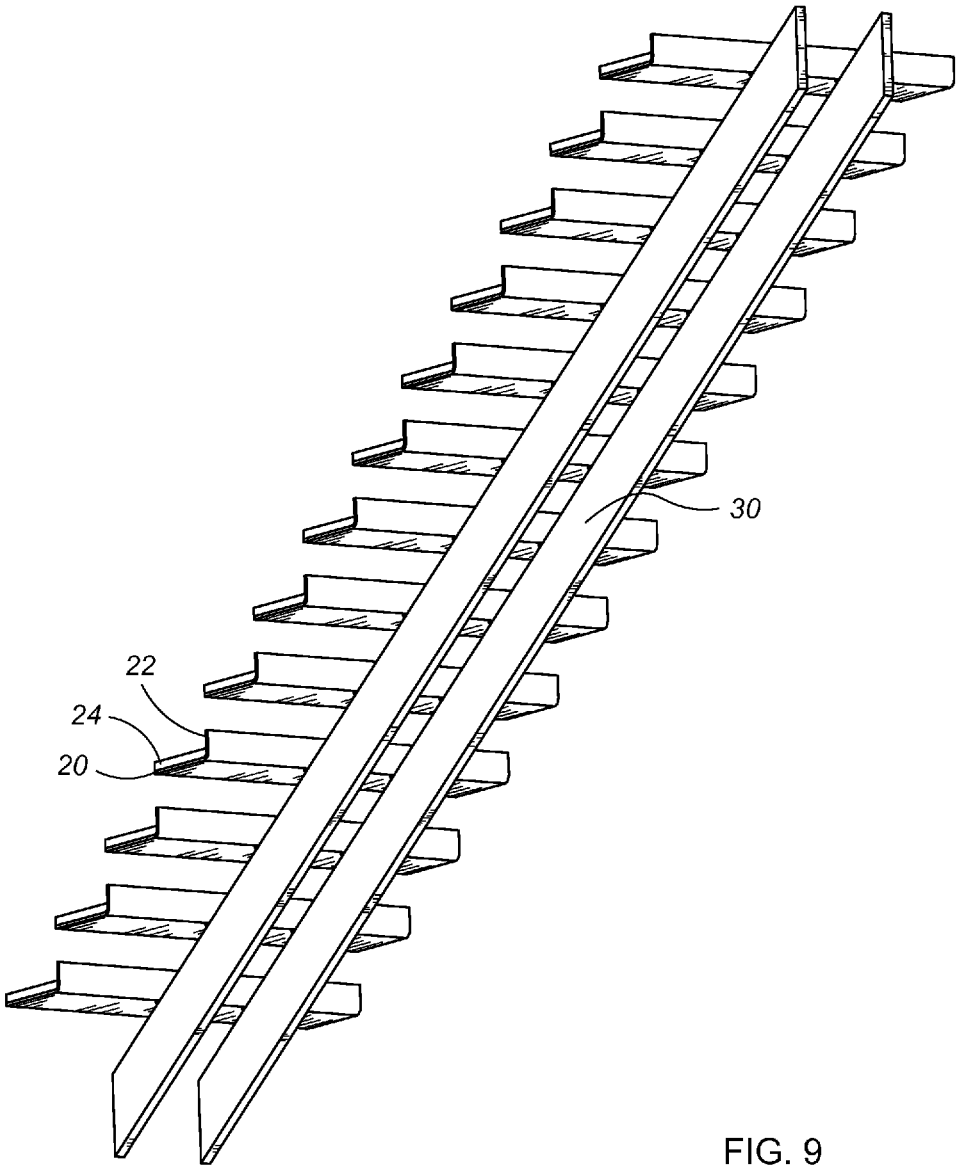
FIG. 9 is a perspective back view of a staircase of the present disclosure.
Figure 10:
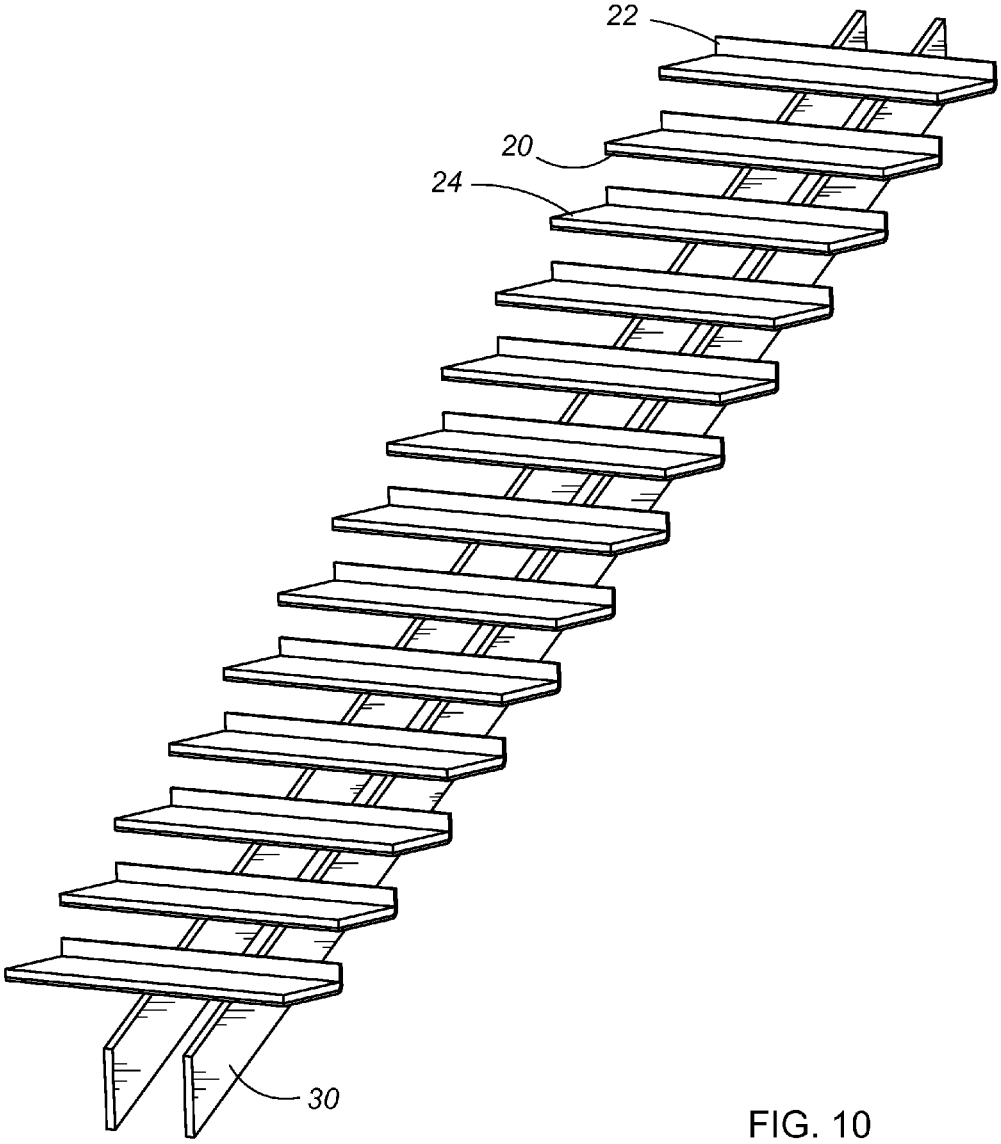
FIG. 10 is a perspective front view of a staircase of the present disclosure.
Figure 11:
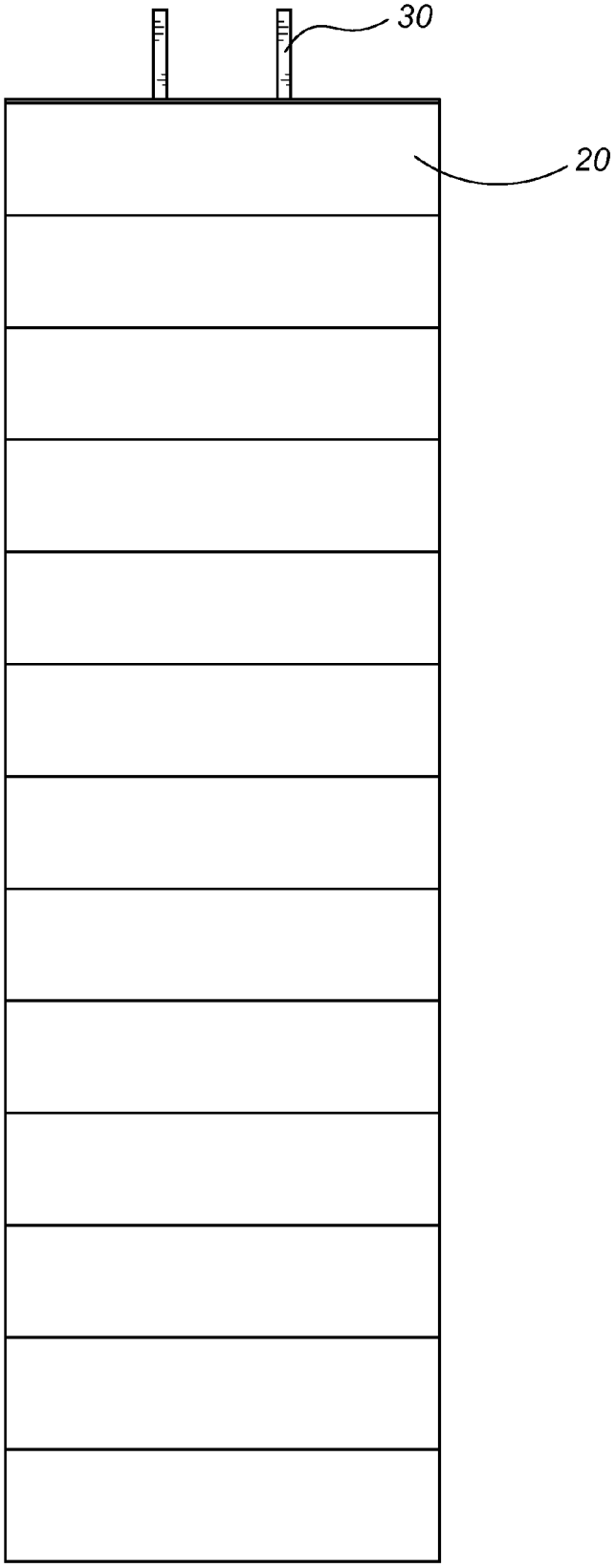
FIG. 11 is a view from above of a staircase of the present disclosure.

FIGS. 8-14 show various perspectives of an open staircase according to the present disclosure, by way of illustration. As will be appreciated by those having ordinary skill in the art, any desired tread width of step 10 can be selected. In one example, the nose end of each tread 20 extends over or "noses" over the riser edge of the tread below. Alternatively, the tread width can just meet the riser edge of the tread below, or even be narrower. FIGS. 8 and 11 show side and top views, respectively, of an embodiment where the tread nose substantially meets the riser edge of the tread below.

Embodiments of this disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes that come within the meaning and range of equivalency of the claims are therefore intended to be embraced therein. While illustrative embodiments have been illustrated and described, it will be appreciated that various changes can be made therein without departing from the spirit and scope of the disclosure.

The embodiments of the invention in which an exclusive property or privilege is claimed are defined as follows:

1. A staircase comprising an uncut stringer and a plurality of steps comprising a tread having a horizontal length with a top and bottom planar surface and free opposing ends, said steps positioned on said stringer in a stepped apart relationship to one another, the improvement wherein:

said tread is secured to said uncut stringer by means consisting essentially of a pin extending down from the bottom planar surface of said tread, said pin dimensioned to fit in an aperture on the tread-facing surface of said stringer, such that said tread contacts said stringer tread-facing surface and is cantilevered over said stringer without apparent visual means of support.

2. The staircase of claim 1 comprising two uncut stringers.

3. The staircase of claim 1 wherein said step further comprises a riser.

4. The staircase of claim 1 wherein said step further comprises a stepping surface mounted on at least a portion of the top planar surface of said tread.

5. The staircase of claim 1 wherein said pin extends down from said bottom planar surface at an angle.

* * * * *